United States Patent [19]

Grosjean

[11] 4,394,200

[45] Jul. 19, 1983

[54] PILE EXTILE ARTICLES AND PROCESS AND DEVICE FOR THEIR MANUFACTURE

[75] Inventor: Pierre Grosjean, Lyons, France

[73] Assignee: Rhone-Poulenc-Textile, Paris, France

[21] Appl. No.: 240,814

[22] Filed: Mar. 5, 1981

Related U.S. Application Data

[63] Continuation of Ser. No. 84,638, Oct. 5, 1979, abandoned.

[30] Foreign Application Priority Data

Oct. 13, 1978 [FR] France ..... 78 29473
Oct. 13, 1978 [FR] France ..... 78 29475
Oct. 13, 1978 [JP] Japan ..... 53/29474

[51] Int. Cl.[3] ..... D04H 11/00

[52] U.S. Cl. ..... 156/72; 428/85; 428/88; 428/95

[58] Field of Search ..... 428/85, 88, 90, 92, 428/95; 156/72; 15/159

[56] References Cited

U.S. PATENT DOCUMENTS 1,956,594 5/1934 Rindskopf ..... 428/95
4,188,429 2/1980 Braconnier ..... 428/95
4,221,833 9/1980 Guillermin ..... 428/92

*Primary Examiner*—Marion McCamish

*Attorney, Agent, or Firm*—Sherman & Shalloway

[57] ABSTRACT

Support with meshes, or elastic flexible openwork grid, used for producing pile textile articles by inserting pile textile elements into its meshes, in which the grid possesses an extensibility of at least 40%, a permanent deformation of less than 5% and an immediate deformation of less than 10%.

Pile textile articles are produced by inserting pile textile elements into the meshes of a flexible grid, in which articles a flexible planar element, which can easily be perforated and comprises a design, is associated with the grid. The pile textile elements are inserted over at least part of the surface of the design. The articles have decorative value as wall or floor coverings, wall hangings or similar decorative articles.

A tool for introducing pile textile elements into a flexible meshed grid is a hollow conical member which is optionally open along at least one generatrix.

Process for introducing pile textile elements into a flexible grid uses the inserting tool; a pile textile element is introduced into the wide part of the cone, the latter subsequently being forced into the mesh of the grid, narrow or pointed end first, and then removed from the grid, leaving in position the pile textile element which locks in the mesh by means of a base member at one end of the element.

1 Claim, 11 Drawing Figures

PILE EXTILE ARTICLES AND PROCESS AND DEVICE FOR THEIR MANUFACTURE

Figure 1:
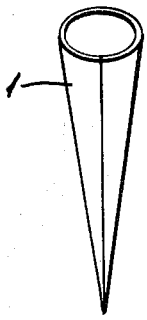

This is a continuation of application Ser. No. 084,638, filed Oct. 5, 1979, now abandoned.

RELATED APPLICATIONS

This application is related to the commonly assigned U.S. application Ser. No. 834,294 filed Sept. 19, 1977, now U.S. Pat. No. 4,255,476, issued Mar. 10, 1981, which is a continuation of application Ser. No. 705,257 filed July 14, 1976, now abandoned. This application is also related to commonly assigned copending U.S. application Ser. No. 878,462 filed Feb. 16, 1978, now U.S. Pat. No. 4,201,032, issued May 6, 1980. These applications describe the pile textile elements used in the present invention and various modes of using and manufacturing such pile textile elements. Accordingly, the disclosures of these commonly assigned U.S. patent applications are incorporated herein by reference.

Pile textile articles and processes for preparing such articles are also the subject matter of the commonly assigned copending U.S. application Ser. No. 864,535 filed Feb. 8, 1978 now U.S. Pat. No. 4,221,833, issued Sept. 9, 1980.

The present application relates to an improvement to the pile textile articles obtained by inserting the pile textile elements into a flexible grid mesh and also to a device for their manufacture.

DISCUSSION OF THE PRIOR ART

French Pat. No. 2,318,964, corresponding to U.S. Ser. No. 705,257, and its 3rd Addition No. 78/03,738, corresponding to U.S. Pat. No. 4,188,429, propose pile textile elements obtained by assembling textile strands arranged in a bundle, one end of which contains the strands in a stable manner, while, at the other end, the strands expand freely, the whole being surrounded by a detachable envelope.

French Pat. No. 2,375,370, corresponding to U.S. Ser. No. 864,535, now U.S. Pat. No. 4,221,833, proposes pile textile articles consisting of at least one pile textile element obtained by assembling textile strands arranged in a bundle, one end of which contains the strands fixed in a stable manner, while, at the other end, the strands expand freely, the elements being held by the fixed end of the strands in the meshes of an elastic flexible grid mesh. The grid used is preferably made of plastic; however, the latter must possess certain characteristics such as, for example, the locking of the base (fixed end) of the pile textile element by locking it in the mesh. See also U.S. patent applications Ser. Nos. 834,294 (U.S. Pat. No. 4,255,476) and 705,257 referred to above.

U.S. Pat. No. 1,956,594 relates to a hollow needle with prongs to catch and hold a binding member which in turn holds a bundle of fibers which forms a tuft or pile. The tuft is placed in the needle and the needle is inserted in a base fabric.

British patent specification No. 1,040,563 describes a process for making wooly fabrics and apparatus which includes a row of parallel needles mounted for endwise recipricatory movement in a common plane through a web of woven material in order to catch tufts from a fleece and pull them through the holes of the web.

An object of the present invention is to provide an improved meshed grid structure of the type used in French Pat. No. 2,375,370 (U.S. Ser. No. 864,535, now U.S. Pat. No. 4,221,833) the disclosure of which is incorporated by reference herein in its entirety.

Accordingly, in one aspect the present invention provides an elastic flexible grid structure used for producing pile textile articles by the insertion of pile textile elements into the meshes of the grid, characterised in that the grid possesses an extensibility of at least 40%, preferably from 50% to 80%, an immediate deformation of less than 10%, and a permanent deformation of less than 5%.

It has been found that a meshed grid structure with these characteristics makes it possible to reconcile the manual or non-manual introduction of the pile textile elements into the meshes with a good wear resistance of the textile elements so introduced.

With the meshed grid of the present invention, it is possible, during the insertion of the pile textile elements, to exceed the elasticity threshold of the grid forming material without flow. Under these conditions, no deformation involving the resistance of the tufts (pile textile elements) or the geometry of the grid can be observed. The measurements are carried out on a tensile tester under the following conditions: measurement on samples having a width of 4 meshes; distance between jaws: 10 centimeters; load: 20 kilograms, applied for 30 seconds; measurement of the deformation expressed as a percentage after one minute for the elastic deformation and after one hour for the permanent deformation.

Numerous materials are very suitable for producing such grids including natural and synthetic elastomers. Especially preferred materials for the grid structure are the ethylene/vinyl acetate (EVA) copolymers. In the ethylene copolymers of the EVA type, which are of particular value, the proportion of vinyl acetate is adjusted so as to achieve the above characteristics, the transparent or opaque nature of the grid depending on the desired appearance, and a greater or lesser rigidity of the grid. The shape of the meshes, defined by the openings between the intersecting transverse and longitudinal parallel members of the grid, can be, for example, square, rectangular, parallelpiped, rhomboidal, etc. The shape of the meshes and the thickness of the transverse and longitudinal members can also influence the tensile strength characteristics of the grid.

The introduction of pile textile elements, by hand or with a suitable tool, into the meshes of the grid is thus facilitated and makes it possible to produce the pile articles for various applications, such as floor coverings, furniture, wall tapestries, clothing, coachwork, decoration and the like.

Although, when it is desired to produce pile articles of a single colour, it suffices to insert the elements one after the other without any difficulty, when it is desired to produce a design comprising several colours, it is, however, necessary to have available a pattern in order to reproduce the design during the introduction of the elements into the grid.

A further object of the present invention is to satisfy this requirement in a simple manner.

Accordingly, in a further aspect the present invention relates to a process for producing pile textile articles by inserting pile textile elements into the meshes of a flexible grid, characterized in that a flexible planar element, which can easily be perforated and comprises a design, is associated with the grid. The planar element can be transparent or non-transparent. The term "design" is understood as meaning either a printed design or an outlined design in the style of dressmaking patterns.

The association of the planar element with the grid is preferably effected by sticking, stapling or stitching and can be removable, if desired. The planar element can be a lightweight, textile or paper, nonwoven or woven or knitted textile web of very open structure. The planar element can be totally covered by the pile textile elements which perforate it, or it can be partially covered and form part of the design or decorative effect which it is desired to produce. The insertion of the pile textile elements through the meshes and planar element can be effected manually or with a suitable tool.

The pile articles produced in this way can be fixedly or removably associated with a textile support or with a cellular plastic structure on their reverse side.

The pile articles produced in this way can be used as floor or wall coverings, or for any desired decorative effect. If the pile article only comprises pile textile elements over part of its surface, the free part consisting of the planar element forms part of the design. The pile article produced can then be used, for example, as a wallpaper and can totally or partially cover entire panels of walls or ceilings, depending on the desired decorative effect. The pile articles can be produced in the form of jigsaw puzzle pieces or checks which fit into one another by means of the row of border meshes of each grid element. The introduction of the pile textile elements into the meshes is generally effected manually; however, experience shows that the compromise between rapid and easy manual introduction and good wear resistance, for example as a floor covering, is frequently difficult to achieve. In practice, the dimensions of each mesh must be relatively small and, as explained above, the sides must not be easily deformable or too extensible; otherwise, the textile elements would not hold. Under these conditions, in order to have an article with good wear resistance, the introduction of the pile textile elements can prove difficult for certain grids in the case of manual introduction.

Therefore, the present invention also provides a means for avoiding this disadvantage and for widening the mesh in order to permit the easy insertion of the pile textile element.

In this aspect, the present invention relates to a device or tool for introducing pile textile elements into a flexible grid. The device is formed of a cone-shaped, strong hollow element which is optionally open along at least one generatrix. The term "cone" is understood as meaning a pyramidal cone or a cone of revolution or a truncated cone. The opening along at least one generatrix enables the cone to keep its own elasticity.

In still a further aspect of the present invention a process is provided for inserting the pile textile elements into the meshes of a flexible grid. According to this process at least one pile textile element is seated in the wide part of a hollow cone, the latter subsequently being forced into the mesh by its narrower conical part and then removed from the grid, leaving in position the pile textile element which locks in the mesh by means of its fixed end.

The introduction of the cone can be effected either through the top side or through the reverse side of the grid, the top side being considered as the face of the grid on which the textile strands expand after the envelope has been removed. The envelope surrounding the strands can be left in position or removed at the same time as the device. The conicity of the device is between a few degrees and 30°, preferably between 5° and 15°. A device of this type does not produce a large local stress on the grid, which stress would have the effect of deforming the grid and causing it to flow.

The cone-shaped hollow element can be made of a variety of materials, such as, for example, plastic, metal or the like. Particular attention should be given to the outside surface condition and to the coefficient of friction of the material against the grid, since very good sliding makes the device easier to use. To insert the pile textile element into the grid, the device may or may not pass through the grid completely; if it does not pass through it completely, the movements to be carried out are simplified as will be described in greater detail below.

The shape of the device must be such that it is easy to handle, can be held firmly in the hand, and is easy to introduce into the grid and easy to withdraw from the grid. In this case, the cone can include as an extension of its narrower end, a gripping means for facilitating its introduction into the grid. If it is still desired to position the pile textile element in the same manner, the interior of the conical element can comprise a stop which limits the depth of introduction of the pile textile element.

Figure 2:
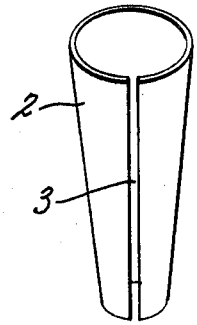
Figure 8:
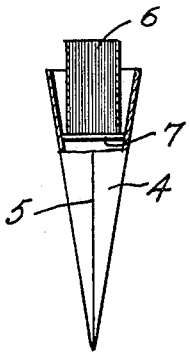
Figure 9:
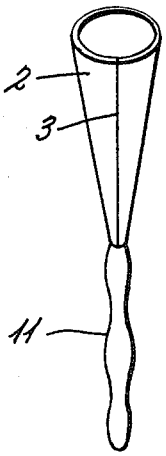
Figure 10:
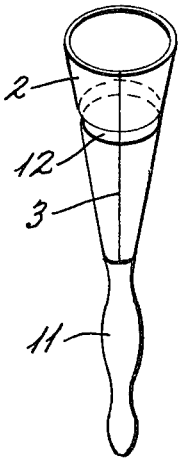
Figure 11:
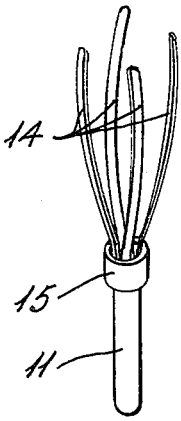

The present invention will be understood more clearly with the aid of the following description and the attached figures given by way of illustrative and non-limiting examples, in which:

FIGS. 1 and 2 show two embodiments of the inserting device; FIGS. 3 to 7 show in sequence the steps of using the inserting device according to an embodiment of the invention; FIG. 8 illustrates an alternative method of inserting a pile textile element in an inserting device of the invention; and FIGS. 9, 10 and 11 show still further embodiments of the inserting device which include extensions from the narrow end thereof serving as handles.

FIG. 1 shows a device 1 in the shape of a cone of revolution, and FIG. 2 shows a device 2 in the shape of a truncated cone of revolution, which is open along a generatrix 3.

Figure 3:
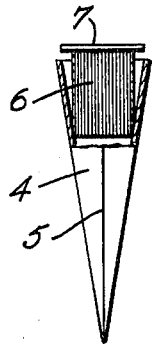

FIG. 3 shows the first step in the sequence of inserting a textile element in a mesh of the grid. The pile textile element 6, which may be obtained in accordance with the process described in the 3rd Addition, Number 78/03,738 (U.S. Pat. No. 4,188,429), to French patent application Ser. No. 2,318,964 is shown in its seated position in the wide (upper) part of the hollow cone inserting device 4 with the base at fixed end 7 protruding slightly above the end of the cone.

Figure 4:
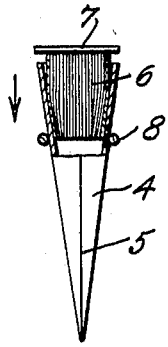
Figure 5:
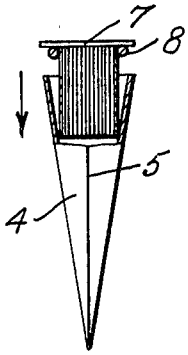
Figure 6:
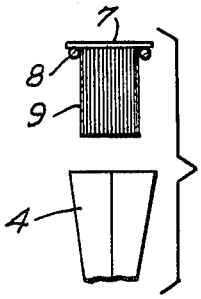
Figure 7:
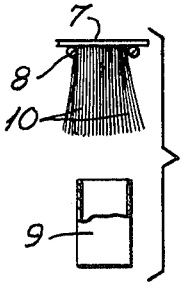

In FIG. 4, the device is introduced into a mesh of a flexible grid which is not shown, the edges of two parallel members of the mesh being shown at 8. During this introduction, the mesh widens and the two edges of the opening 5 in the cone overlap, squeezing the pile textile element 6. In a second stage, in FIG. 5, the cone 4 and textile element 6 have passed through the mesh, which returns to its initial position, and the pile textile element is locked in the mesh by the edges of its base 7. In a third stage, in FIG. 6, the cone 4 is removed from the pile textile element leaving behind its detachable envelope 9. In a final stage, shown in FIG. 7, the envelope 9 is removed, freeing the strands 10 in order to facilitate the expansion of the strands; this operation can, if desired, be carried out subsequently, for example after all of the textile elements have been positioned.

In an alternative procedure the positioning of the pile textile element can be effected by inserting the element in the cone with the base near the narrowest part, the free strands being near the widest part, as shown in FIG. 8. The step illustrated in FIGS. 4, 5, 6 and 7 would then be followed except that the inserting device would be passed through the mesh from top to bottom rather than from bottom to top as shown in FIG. 4.

FIG. 9 shows an alternative embodiment of the inserting device according to the invention, which is provided with a manual gripping means or handle 11. The handle may be a separate element glued, welded or otherwise permanently or removably connected to the narrow end of the conical inserting device 2. The handle may also be an integral component of the cone 2, for example, formed by extrusion or injection molding. The handle may be solid or hollow.

FIG. 10 shows a still further embodiment of the inserting 2 device provided with an internal stop 12 in the form of an annular ring.

The use of a tool of the type shown in FIG. 10 provides significant advantages, namely speed of execution; ease of use by any person, without fatigue; uniform introduction of the pile textile elements to the same depth; and reduction in the risk of flow of the grid, which flow detracts from the satisfactory locking of the base of the pile textile element, the latter not being subjected to any risk of damage by this process.

Using the conical inserting device of this invention, it becomes possible to simultaneously introduce one or more pile textile elements of, for example, different colours, heights and appearances; an operation of this kind is generally impossible or difficult to carry out manually. Accordingly, simple complex designs can easily be produced in pile textile articles. After insertion, the reverse side of the pile article produced can be glued or provided with a coarse haircloth, or the pile textile elements can be secured to the meshed grid in any other manner, for example, by heat fusing as shown, for example in the copending application Ser. No. 834,294.

In another alternative embodiment of the process of this invention using the inserting device shown in FIG. 11, it is possible to work with an up-and-down movement of the inserting device through the grid without the device passing through the grid completely. A large part of the device will remain, for example, underneath the grid. The conical inserting device includes a truncated cone as defined by a plurality (three, four, five or more) of fingers along the generatrices of the cone. Means are provided for releasably compressing the fingers radially inwardly such that the dimension of the widest part of the cone, i.e. the base or open end, becomes less than the smallest dimension of a mesh of the flexible grid. In this case, a pile textile element is seated in the open cone and the cone and textile element are inserted into the grid. The cone is then pulled through the grid in order to insert the textile element and to lock it in the mesh as described above. When the cone is removed from the textile element, the compressing means are actuated such that the cone closes up in the sense that the open edges of the generatrices (fingers) join together, forming a diameter at the base of the cone which is narrower than the opening in the mesh, thus enabling the device to re-enter the mesh empty, so that a further pile textile element can be introduced into the device.

As shown in FIG. 11, the conical inserting device includes the truncated cone, defined by the four fingers 14 (a different number of fingers, for example 3 or 5 can also be used) which is connected at its narrow end to handle 13. A ring 15 which may be plastic, metal, wood, etc. can slide upwardly (not shown) to squeeze together fingers 14. The diameter of ring 15 will be less than the smallest dimension of the opening in the grid.

In place of ring 15, it would be possible, for example, to make handle 13 hollow and to have fingers 14 retractible in the hollow handle with a suitable stop mechanism which will releasably hold the fingers in the extended or retracted position, for example, spring-loaded detents at the top and base of the hollow handle which fit into an indent provided at the narrow end connecting the fingers 14 together.

The following examples illustrate the present invention without limiting it.

COMPARATIVE EXAMPLE

A grid with square meshes having the following characteristics is employed: side length of mesh 8 mm; thickness of filament 2.5 mm; composition: ethylene/vinyl acetate copolymer containing 18% of vinyl acetate. The pile textile elements or tufts are formed from a bundle of 50 threads, each produced by twisting together, with a twist of 100 turns in the Z direction, two threads which have a twist of 100 turns in the S direction and each consisting of 136 strands/2,800 dtex of polyhexamethylene adipamide, and possess the following characteristics: diameter 13 mm; height 23 mm. The manual introduction of tufts into one mesh in 4 is very easy.

However, after manual introduction over one square meter, the following is observed: 4 meshes which have suffered local flow and 15 tufts with a split or damaged base.

This carpet is not totally plane. Slight undulations are observed at the border.

EXAMPLE 1

The same tufts as used in the Comparative Example were inserted into the same grid used in the Comparative Example but using the conical inserting device as shown in FIG. 8. The inserter had the following characteristics: open diameter 14 mm; conicity 8°; length 12 centimeters. None of the meshes suffered flow and no damaged tufts were observed over one square meter of the grid. The carpet remains flat.

EXAMPLE 2

The grid employed possessed the following characteristics: mesh of 8×9.5 mm; diameter of filament 2 mm; weight of the grid 480 g/m$^2$; square grid having a side length of 98 cm; composition: ethylene/vinyl acetate copolymer containing 3.6% of vinyl acetate. Tufts of diameter 13 mm and height 25 mm, such as those in Example 1, were introduced by means of a conical inserting device with a handle as illustrated in FIG. 11. The diameter of the widest part of the fingers was 14 mm. By raising the ring, the fingers are squeezed together to give an inscribed diameter of 7 mm. In this position, the tool is introduced into a mesh of the grid from underneath. The arms are then opened and a tuft is seated in the cone within the fingers so that the free end of the strands is near the widest part of the cone, i.e. as shown in FIG. 8. The assembly is pulled downwards and the tuft is deposited in the grid.

A device of this type makes it possible to introduce the tufts into the grid as rapidly as possible, without unnecessary movement. Each row of the grid is thus covered with tufts, with the exception of the outside row. To finish, the square elements are successively assembled to form an approximately 2 m×1 m carpet.

The assembling is carried out using the tufts themselves, which are passed, using the tool, through two grid elements. Clipping-in by hand, without the tool, proves very difficult under the same conditions.

EXAMPLE 3

The grid used has square meshes having a side length of 9 mm and is made of plastic, namely ethylene/vinyl acetate copolymer containing 13% of vinyl acetate, the filaments between meshes having a thickness of 2 mm. The grid possesses an extensibility of 60%, an immediate deformation of 9% and a permanent deformation of 4%.

Pile textile elements having a diameter of 13 mm and a height of 25 mm, obtained, as described in the 3rd Addition, No. 78/03,738, to the French Patent Application published under No. 2,318,964, from a bundle of 50 threads, each produced by twisting together, with a twist of 100 turns in the Z direction, two threads which each have a twist of 100 turns in the S direction and each consisting of 136 strands/2,800 dtex of polyhexamethylane adipamide, are introduced into the grid without difficulty; the envelope used is a polyethylene film.

In the pile article thus obtained, the pile textile elements are wear resistant.

EXAMPLE 4

A pile textile article is produced using the following materials:

grid: made of plastic, namely ethylene/vinyl acetate copolymer containing 18% of vinyl acetate; square meshes having a side length of 9 mm; thickness of filaments between meshes 2.5 mm; the grid possesses an extensibility of 55% with an immediate deformation of 9% and a permanent deformation of 4%;

planar textile element: non-woven made of cellulose fibers, weighing 80 g/m$^2$, comprising a design and associated with the grid by sticking;

pile textile elements having a diameter of 13 mm and a height of 25 mm, formed from a bundle of 50 threads, each produced by twisting together, with a twist of 100 turns in the Z direction, two threads which each have a twist of 100 turns in the S direction and each consisting of 136 strands/2,800 dtex of polyhexamethylene adipamide, the envelope used being a polyethylene film, and the textile elements being produced as described in the 3rd Addition, No. 78/03,738, to the French Patent Application published under No. 2,318,964.

The textile elements are introduced through the pattern, according to the design, by means of a device in the shape of a cone which is open along three generatrices.

After introducing the pile textile elements, sticking is carried out on the reverse side, using an internally plasticised acrylic glue in aqueous emulsion, at the rate of 400 g/m$^2$.

This gives a floor covering in which the pile textile elements inserted have a good stability.

EXAMPLE 5

A floor covering is produced using the pile textile elements and the grid of Example 1, on which grid a light woven fabric, weighing 60 g/m$^2$ and comprising a printed design, has been stuck; the distance between threads is 2 mm. The pile textile elements are introduced through the woven fabric, and the warp and weft threads spread out and preferentially block the unused meshes of the grid.

EXAMPLE 6

A wall covering is produced using the pile textile elements and the grid of Example 1, on which grid strips of wall tapestry, having a height of 3 m and a width of 0.98 m, are stuck. Part of the design of the wallpaper acts as a guide for the introduction of the pile textile elements. A wall covering is thus obtained which comprises wallpaper parts and textile parts.

What is claimed is:

1. A process for introducing pile textile elements in the form of bundles of a plurality of substantially parallel filamentary textile materials having a base stably joining the materials at one end of the bundle into the meshes of a flexible meshed grid wherein the dimension of the base is slightly greater than the openings of the meshes of said grid, comprising (1) seating said pile textile element in a truncated cone-shaped inserting tool which is open at its wide end, said cone being defined by a plurality of radially inwardly compressible fingers along the generatrices of the cone, (2) passing the cone-shaped inserting tool with the pile textile element seated therein through a mesh of the grid from one side to the other side thereof, (3) removing the cone-shaped tool from the tile textile element while leaving the element locked in said mesh by means of said base, (4) radially inwardly collapsing said fingers so that the diameter of the wide end of the cone becomes narrower than the opening of the meshes of the meshed grid, (5) passing the opened end of the collapsed cone through an empty mesh of said grid from said other side to said one side, (6) expanding said fingers to their normal opening so that the step (1) may be repeated, and (7) repeating the steps (1)–(6) at least once.

* * * * *

UNITED STATES PATENT AND TRADEMARK OFFICE

CERTIFICATE OF CORRECTION

PATENT NO. : 4,394,200

DATED : July 19, 1983

INVENTOR(S) : Pierre Grosjean

It is certified that error appears in the above—identified patent and that said Letters Patent is hereby corrected as shown below:

Change the title "PILE EXTILE ARTICLES AND PROCESS AND DEVICE FOR THEIR MANUFACTURE" to ---PILE TEXTILE ARTICLES AND PROCESS AND DEVICE FOR THEIR MANUFACTURE---

Claim 1, line 42, after "tool from the" change "tile" to ---pile---

Signed and Sealed this

*Twentieth* Day of *September 1983*

[SEAL]

*Attest:*

GERALD J. MOSSINGHOFF

*Attesting Officer*

*Commissioner of Patents and Trademarks*